US010494845B2

(12) United States Patent
Yamaguchi

(10) Patent No.: US 10,494,845 B2
(45) Date of Patent: Dec. 3, 2019

(54) DOOR HINGE FOR A DOOR AND A DOOR FRAME

(71) Applicant: Sugatsune Kogyo Co., Ltd., Tokyo (JP)

(72) Inventor: Koushi Yamaguchi, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 15/322,989

(22) PCT Filed: Jun. 11, 2015

(86) PCT No.: PCT/JP2015/066866
§ 371 (c)(1),
(2) Date: Dec. 29, 2016

(87) PCT Pub. No.: WO2016/002465
PCT Pub. Date: Jan. 7, 2016

(65) Prior Publication Data

US 2017/0130497 A1 May 11, 2017

(30) Foreign Application Priority Data

Jul. 3, 2014 (JP) ..... 2014-137697

(51) Int. Cl.
*E05D 3/18* (2006.01)
*E05D 3/16* (2006.01)

(52) U.S. Cl.
CPC ..... *E05D 3/186* (2013.01); *E05D 3/16* (2013.01); *E05D 2003/166* (2013.01); *E05Y 2600/41* (2013.01); *E05Y 2900/132* (2013.01)

(58) Field of Classification Search
CPC ..... E05D 3/186; E05D 3/142; E05D 3/06; E05D 3/18; E05D 3/183; E05D 7/04;
(Continued)

(56) References Cited

U.S. PATENT DOCUMENTS 2,008,257 A * 7/1935 Lefevre ..... E05D 3/18 16/360
2,045,955 A * 6/1936 Lefevre ..... E05D 3/186 16/358

(Continued)

FOREIGN PATENT DOCUMENTS

DE 173 585 C 7/1906
DE 102 39 446 C1 8/2003

(Continued)

OTHER PUBLICATIONS

International Search Authority/JPO, International Search Report dated Sep. 1, 2015 in International Patent Application No. PCT/JP2015/066866 (with English translation), 2 pages.

(Continued)

*Primary Examiner* — Emily M Morgan
(74) *Attorney, Agent, or Firm* — Masuvalley & Partners

(57) ABSTRACT

Embodiments of the present invention provide a hinge capable of increasing strength. Said hinge may include a first hinge main body, a second hinge main body, a first arm and a second arm. The first arm of said hinge includes an opening and is formed into a single closed-shape piece enclosing the opening. The second arm of the hinge being inserted into the opening of the first arm and further includes a main body section whose height does not exceed a height of the opening of the first arm in the vertical direction. Further, a first and a second protrusion are provided to fill a gap between the main body section of the second arm and the second hinge main body. Additionally, a third and a fourth protrusion are provided to fill another gap formed between the main body section of the second arm and the first hinge main body.

3 Claims, 14 Drawing Sheets

(58) Field of Classification Search
CPC ..... E05D 7/0415; E05D 2007/0476; E05D 2007/0492; E05D 2007/0484
See application file for complete search history.

(56) References Cited

U.S. PATENT DOCUMENTS

2002/0073509 A1* 6/2002 Dean ..... E05D 7/0415 16/387
2003/0088943 A1* 5/2003 Neukotter ..... E05D 3/186 16/366
2008/0244866 A1* 10/2008 Stanley ..... E05D 7/0027 16/238
2008/0307606 A1* 12/2008 Karlsson ..... E05D 7/0415 16/243
2010/0115729 A1* 5/2010 Neukoetter ..... E05D 3/186 16/235
2010/0122431 A1* 5/2010 Neukoetter ..... E05D 3/186 16/238
2013/0219662 A1* 8/2013 Neukoetter ..... E05D 3/186 16/368
2013/0333160 A1* 12/2013 Ochs ..... E05D 7/0009 16/236
2017/0152689 A1* 6/2017 Liermann ..... E05D 7/0415

FOREIGN PATENT DOCUMENTS

DE 102004054708 B3 2/2006
DE 20 2010 010645 U1 10/2010
DE 102012101644 B3 10/2012
EP 3 165 699 A1 5/2017
JP H03-62978 U 6/1991
JP H04-27089 A 1/1992
JP 2012-241515 A 12/2012
WO 2011/013335 A1 2/2011

OTHER PUBLICATIONS

EPO, Communication pursuant to Rule 114(2) EPC dated Oct. 27, 2017 in European Patent Application No. 15815385.8; Third party observations filed on Oct. 9, 2017 against European Patent Application No. 15815385.8, 13 pages including English translation.
EPO, Extended European Search Report dated Jan. 23, 2018 in European Patent Application No. 15815385.8, 8 pages.

* cited by examiner

DOOR HINGE FOR A DOOR AND A DOOR FRAME

CROSS-REFERENCE TO RELATED APPLICATIONS

This application is a national phase application under 35 U.S.C. § 371 of International Application No. PCT/JP2015/066866, filed on Jun. 11, 2015, which claims priority under 35 U.S.C. § 119 to Japanese Patent Application No. 2014-137697, filed on Jul. 3, 2014, which are hereby expressly incorporated by reference in their entirety for all purposes.

TECHNICAL FIELD

The present invention relates to a hinge provided between a door and a frame to openably support the door.

BACKGROUND ART

One type of such hinges is disclosed in Patent Document 1: DE 102004054708 B3. As shown in FIG. 16, this hinge comprises a first hinge main body 101, which will be attached to a door, and a second hinge main body 102, which will be attached to a frame. Between the first and the second hinge main bodies 101 and 102, provided are a first and a second main arms 103 and 114. With the first and second hinge main bodies 101 and 102, positional adjusters 104*a*, 104*b*, 105*a* and 105*b* are assembled for performing fine-adjustment respectively to the positions of the door in vertical, horizontal and anteroposterior directions with respect to the frame.

The first arm 103 has its base end section pivotally supported by the positional adjusters 104*a* and 104*b* of the first hinge main body 101 through pivots 106*a* and 106*b*, and its fore end section pivotally and slidably supported through rotating blocks 107*a* and 107*b* by the positional adjusters 105*a* and 105*b* of the second hinge main body 102. Correspondingly, the second arm 114 has its base end section pivotally supported by the positional adjusters 105*a* and 105*b* of the second hinge main body 102 through pivots 108*a* and 108*b*, and its fore end section pivotally and slidably supported through rotating blocks 109*a* and 109*b* by the positional adjusters 104*a* and 104*b* of the first hinge main body 101.

The first arm 103 is formed into a C-shape. The second arm 114 is formed into an H-shape such that a main body section 114*a* extends in the horizontal direction. The main body section 114*a* of the second arm 114 is inserted into an opening 103*a* of the first arm 103 in such a way that the first arm 103 intersects with the second arm 114. The first arm 103 is rotatably coupled to the second arm 114 via arc-shaped bearings 110*a* and 110*b*. It is to be noted that in a typical hinge, the first arm 103 is pivotally coupled to the second arm 114 via a pivot instead of the arc-shaped bearings 110*a* and 110*b* (e.g. see Patent Document 2: JP 2012-241515 A).

When the door is opening, the first arm 103 rotates with respect to the first and second hinge main bodies 101 and 102 while the second arm 114 rotates with respect to the first and second hinge main bodies 101 and 102. In addition, the first and second arms 103 and 114 rotate relatively to each other.

The first and second arms 103 and 114 of the hinge are under loads of door weight, moment and others. In a conventional hinge, the first arm 103 is formed into the C-shape so that the second arm 114 can be inserted into the first arm, which therefore causes a problem that the strength of the first arm 103 cannot be enhanced. In order to overcome such a problem, a spacer 112 is fitted in the first arm 103 after inserting the second arm 114 into an opening 103*a* of the first arm 103. However, that causes the spacer 112 to rattle, thus failing to enhance the strength of the first arm 103.

It is therefore an object of the present invention to solve the above-described problem and provide a hinge, of which strength can be enhanced.

SUMMARY OF THE INVENTION

The present invention intends to provide novel configurations of a slide-type hinge and a link-type hinge. In the description, reference numerals shown in the accompanying drawings are inserted with parentheses for easier comprehension of the present invention, but are not for limiting the present invention to the illustrative embodiments.

In order to solve the aforementioned problems, an aspect of the present invention relates to a slide-type hinge, which includes a first hinge main body 1 attachable to either one of a door d and a frame f, a second hinge main body 2 attachable to the other one of the door d) and the frame f, a first arm 3 having its base end section 3*a* pivotally supported by the first hinge main body 1 and its fore end section 3*b* pivotally and slidably supported by the second hinge main body 2, and a second arm 4 having its base end section 4*a* pivotally supported by the second hinge main body 2 and its fore end section 4*b* pivotally and slidably supported by the first hinge main body 1, wherein the first arm 3 has an opening 3*g* and is formed into a single, closed piece enclosing the opening 3*g*, and the second arm 4 is inserted into the opening 3*g* of the first arm 3 and has a main body section 4*c* whose height does not exceed the height of the opening 3*g* in a vertical direction, and wherein a first protrusion 31 is provided for filling a first gap δ1 between an upper surface of the main body section 4*c* of the second arm 4 and the second hinge main body 2, a second protrusion 32 is provided for filling a second gap δ2 between a lower surface of the main body section 4*c* of the second arm 4 and the second hinge main body 2, a third protrusion 33 is provided for filling a third gap δ3 between the upper surface of the main body section 4*c* of the second arm 4 and the first hinge main body 1, and a fourth protrusion 34 is provided for filling a fourth gap δ4 between the lower surface of the main body section 4*c* of the second arm 4 and the first hinge main body 1.

Another aspect of the present invention relates to a link-type hinge, which includes a first hinge main body 51 attachable to either one of the door d and the frame f, a second hinge main body 52 attachable to the other one of the door d and the frame f, a first arm 54 having its base end section 54*a* pivotally supported by the first hinge main body 51 and its fore end section 54*b* supported by the second hinge main body 52 via a first link 56, and a second arm 55 having its base end section 55*a* pivotally supported by the second hinge main body 52 and its fore end section 55*b* supported by the first hinge main body 51 via a second link 57, wherein the first arm 54 has an opening 54*g* and is formed into a single, closed piece enclosing the opening 54*g*, the second arm 55 is inserted into the opening 54*g* of the first arm 54 and has a main body section 55*c* whose height does not exceed the height of the opening 54*g* in a vertical direction, and wherein a first protrusion 71 is provided for filling a first gap δ1 between an upper surface of the main body section 55*c* of the second arm 55 and the second hinge main body 52, and a second protrusion 72 is provided for filling a second gap δ2 between a lower surface of the main body section 55*c* of the second arm 55 and the second hinge main body 52.

It is to be noted that according to the embodiments of the present invention, the vertical direction means "upward and downward" of the door when the hinge is used to the door openable in the horizontal direction.

In accordance with one aspect of the present invention, the first arm is formed into a single, closed piece enclosing the opening, so that the strength of the first arm can be enhanced. Furthermore, even though the height of the main body section of the second arm gets lower in the vertical direction for inserting the second arm into the opening of the first arm, the first to fourth protrusions are provided to fill the gaps δ1 through δ4 so as to allow the second arm to come into contact with the first and second hinge main bodies at four points in total. Thus, the second arm can bear a load stably at these four points.

In accordance with the other aspect of the present invention, the first arm is formed into a single, closed piece enclosing the opening, so that the strength of the first arm can be enhanced. Moreover, even though the height of the main body section of the second arm gets lower in the vertical direction for inserting the second arm into the opening of the first arm, the first and second protrusions are provided to fill the gaps so as to allow the base end section of the second arm to come into contact with the second hinge main body at two points, and thereby the second arm can bear a load stably at those two points.

BRIEF DESCRIPTION OF THE DRAWINGS

FIG. 6A depicts a cross-sectional view taken along line A-A of FIG. 2, FIG. 6B depicts a cross-sectional view taken along line B-B of FIG. 2, and FIG. 6C depicts a cross-sectional view taken along line C-C of FIG. 2.

FIG. 8A depicts a conventional hinge, and FIG. 8B depicts an exemplary embodiment of a hinge according to the first embodiment.

DETAILED DESCRIPTION OF THE INVENTION

With reference to the accompanying drawings, preferred embodiments of a hinge according to the present invention will now be described in detail. The hinge of the present invention can be classified into a slide-type hinge (first, second and third embodiments) and a link-type hinge (fourth embodiment). Description will first be made on the slide-type hinge.

Figure 1:
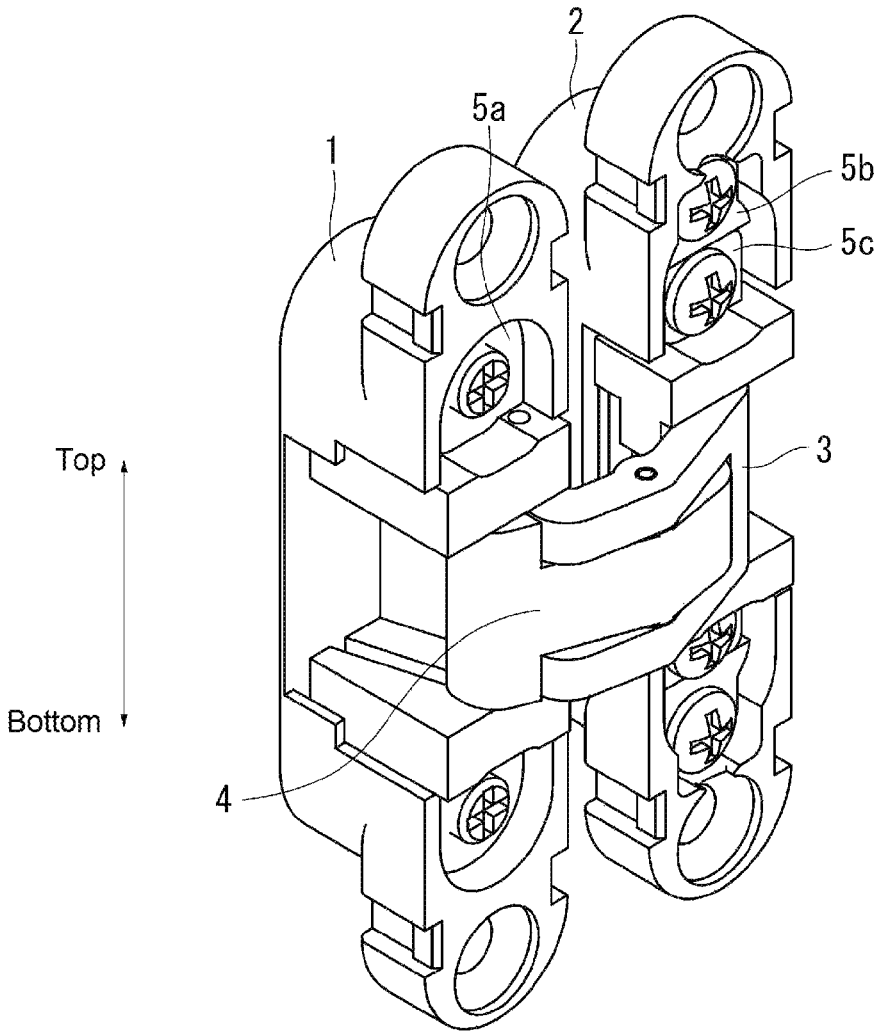
FIG. 1 is a perspective view of a hinge of a first embodiment according to the present invention.
Figure 2:
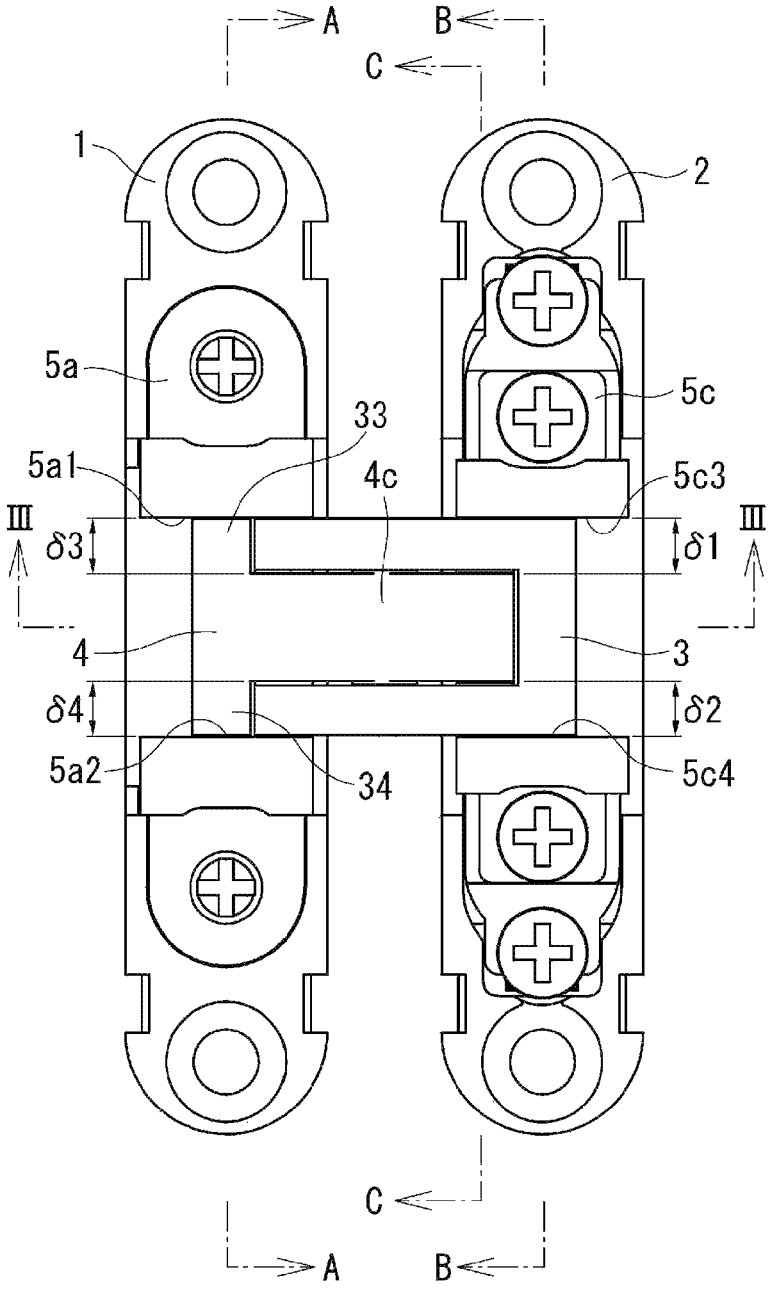
FIG. 2 is a front view of the hinge of the first embodiment.

FIG. 1 shows a perspective view of a slide-type hinge of a first embodiment according to the present invention (hereinafter referred to simply as "hinge"), and FIG. 2 shows a front view of the hinge. The hinge is adapted to be used for horizontally opening and closing a door d. The hinge includes a first hinge main body 1 which will be attached to either one of the door d or the frame f, and a second hinge main body 2 which will be attached to the other one of the door d or the frame f. Between the first and the hinge main body 1 and 2, a first and a second arm 3 and 4 are provided.

Figure 3A:
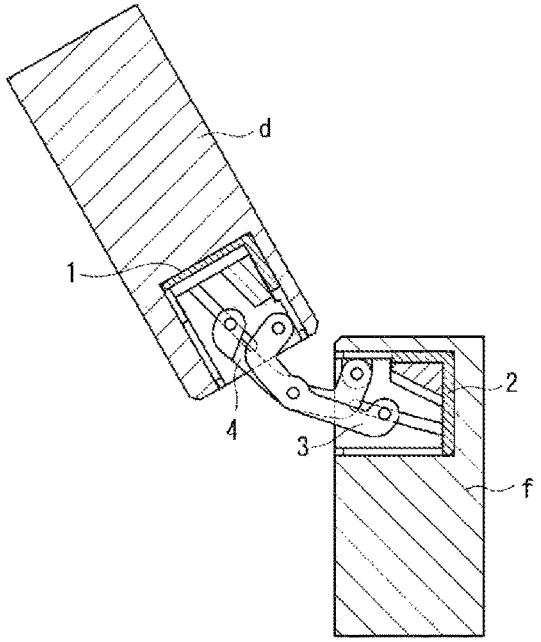
FIGS. 3A and 3B are cross-sectional views taken along line III-III of FIG. 2.
Figure 3B:
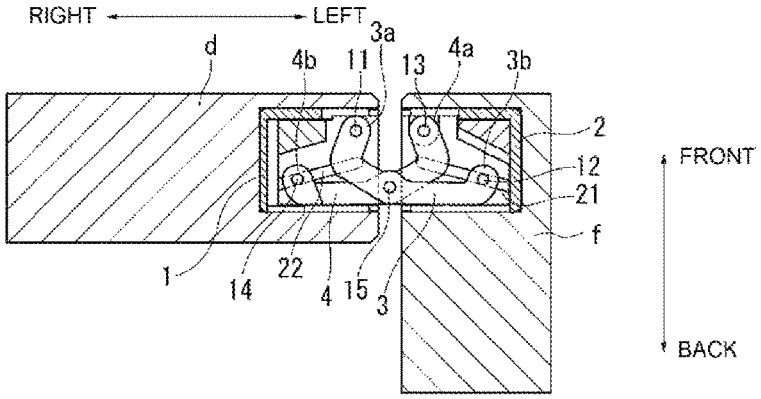

FIG. 3A and FIG. 3B show horizontal sectional views of the hinge. FIG. 3B particularly shows the hinge in a state where the door d is at its closed position whereas FIG. 3A shows the hinge in a state where the door d is in between its closed and open positions. As shown in FIG. 3B, the first hinge main body 1 is embedded in a cut-in part formed in the side of a door d. The second hinge main body 2 is embedded in a cut-in part formed in a frame f, facing the side of the door d. In order to prevent impairment of the design of the door d, the hinge is mounted to be invisible from outside when the door d is closed.

In the following description, the term "vertical direction" is "upward and downward" of the door d when the hinge is used to the door d that opens in the horizontal direction (see FIG. 1), and the terms "horizontal direction" and "anteroposterior direction" are directions "right and left" and "front and rear" of the door, respectively, as viewed from the front face of the door d (see FIG. 3B).

As shown in FIG. 1, the first and second hinge main bodies 1 and 2 are provided with positional adjusters 5*a* to 5*c* for adjusting a three-dimensional position of the door d. The positional adjusters 5*a* to 5*c* are composed of a horizontal positional adjuster 5*a* capable of adjusting a position in the horizontal direction of the door d (see FIG. 3B), a vertical positional adjuster 5*b* capable of adjusting a position in the vertical direction of the door d, and an anteroposterior positional adjuster 5*c* capable of adjusting a position in the anteroposterior direction of the door d (see FIG. 3B).

As shown in FIG. 3B, the first arm 3 has its base end section 3*a* pivotally supported by the first hinge main body 1 via a pivot 11, and has its fore end section 3*b* slidably and pivotally supported by the second hinge main body 2 via a pivot 12. In the second hinge main body 2, a groove 21 is formed which allows the pivot 12 to slide therein. The second arm 4 has its base end section 4*a* pivotally supported by the second hinge main body 2 via a pivot 13, and has its fore end section 4*b* slidably and pivotally supported by the first hinge main body 1 via a pivot 14. In the first hinge main body 1, a groove 22 is formed which allows the pivot 22 to slide therein. The first arm 3 decussates with the second arm 4. Moreover, the first arm 3 is coupled to the second arm 4 such that they can pivot on a pivot 15. This hinge includes five pivots 11 through 15, of which two pivots 12 and 14 can slide with respect to the first and second hinge main bodies 1 and 2.

Figure 4:
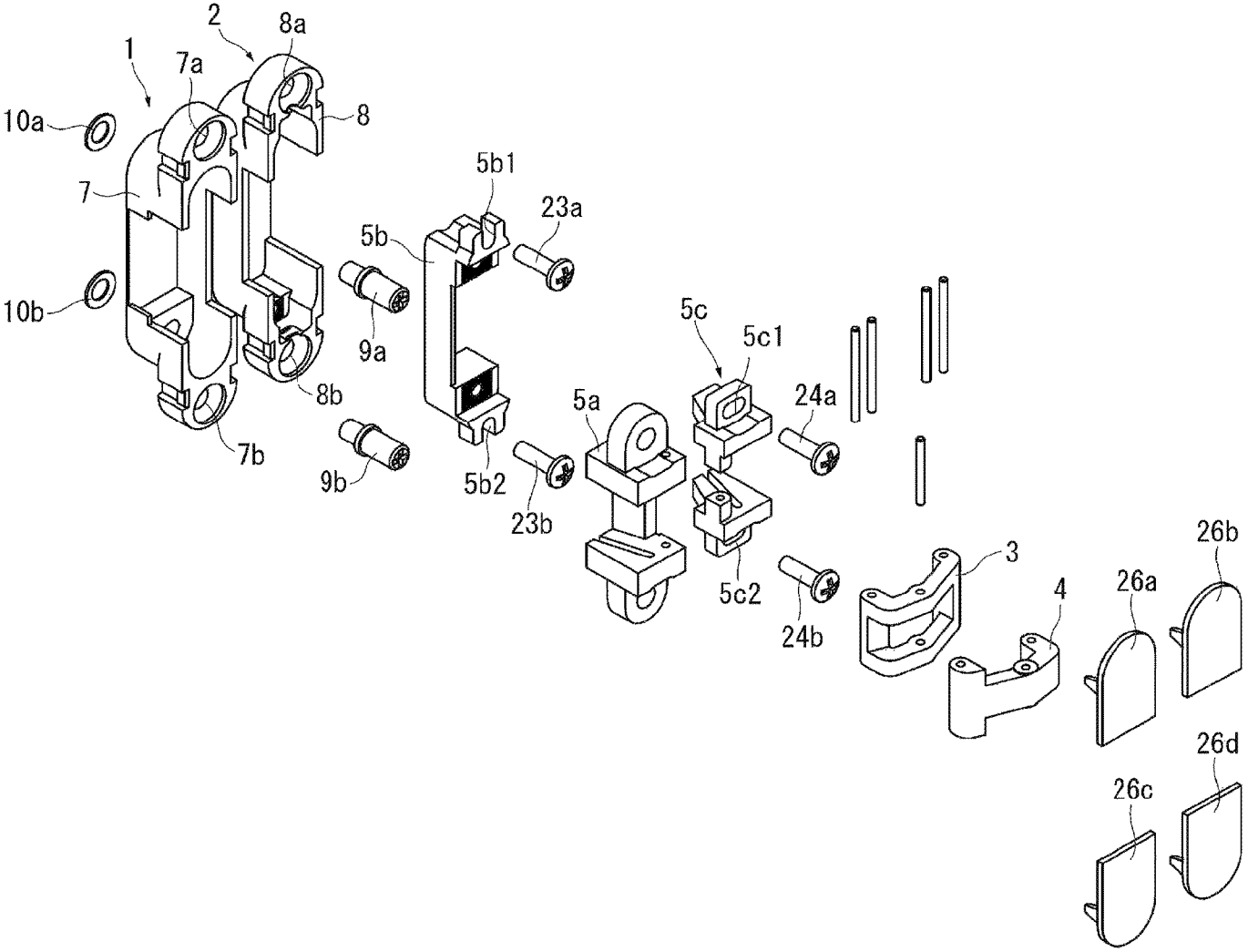
FIG. 4 is an exploded perspective view of the hinge of the first embodiment.

FIG. 4 shows an exploded perspective view of the hinge. As described above, the hinge includes the first and second hinge main bodies 1 and 2, and the first and second arms 3 and 4. In the following, those components will be described in turn.

Figure 6C:
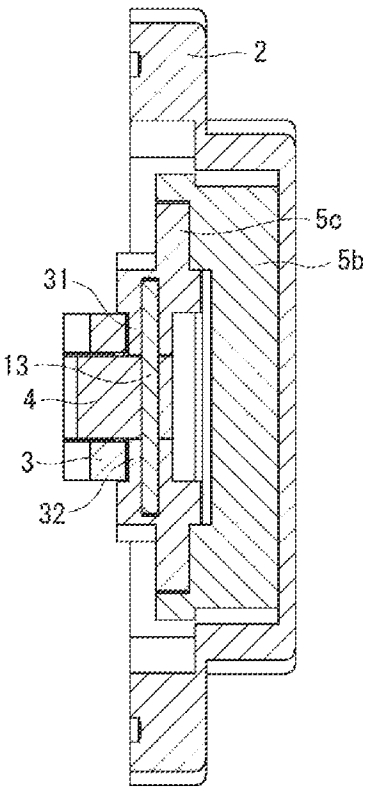
FIGS. 6A-6C are vertical sectional views of the hinge of the first embodiment.
Figure 6B:
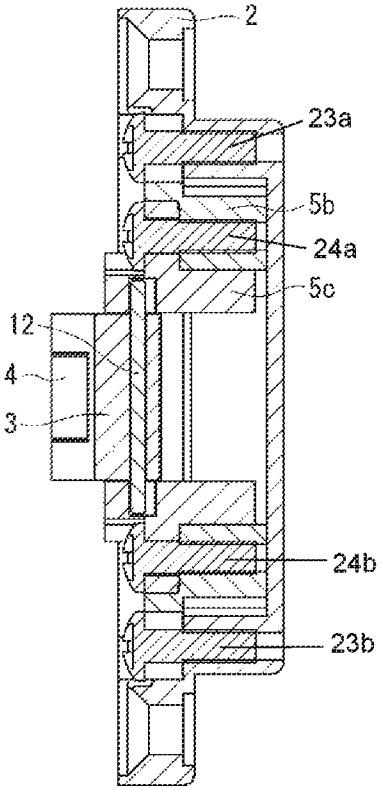
Figure 6A:
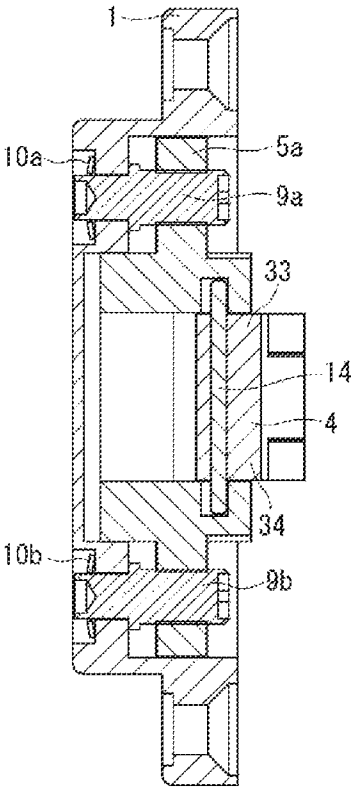

The first hinge main body 1 includes a base frame 7 to be attached to the door d, and the horizontal positional adjuster 5*a* capable of positional adjustment relative to the base frame 7. Formed in the base frame 7 are through holes 7*a* and 7*b* for introducing attachment screws, not shown, for mounting the base frame 7 on the door d. To the base frame 7, horizontal adjustment screws 9*a* and 9*b* are attached pivotally but axially-immovably (see also the cross-sectional view as shown in FIG. 6A). The tip parts of the horizontal adjustment screws 9*a* and 9*b* are respectively provided with washers 10*a* and 10*b* for preventing the slip off of the horizontal adjustment screws 9*a* and 9*b*. The horizontal adjustment screws 9*a* and 9*b* threadedly engage with the horizontal positional adjuster 5*a*. When the horizontal adjustment screws 9*a* and 9*b* are turned, the horizontal positional adjuster 5*a* is pushed up from or into the base frame 7. It allows the positional adjustment of the door d in the horizontal direction. If the positional adjustment function is not required, the horizontal positional adjuster 5*a* can be integrated into the base frame 7.

The second hinge main body 2 includes a base frame 8 which will be attached to a frame f, the vertical positional adjuster 5*b* capable of positional adjustment in the vertical direction with respect to the base frame 8, and the anteroposterior positional adjuster 5*c* capable of positional adjustment in the horizontal direction with respect to the vertical positional adjuster 5*b* (anteroposterior direction in FIG. 3B). In the base frame 8, through holes 8*a* and 8*b* are formed for introducing attachment screws, not shown, for mounting the base frame 8 on the frame f. The vertical positional adjuster 5*b* is provided with elongate holes 5*b*1 and 5*b*2 extending in the vertical direction. The elongate holes 5*b*1 and 5*b*2 are for introducing therethrough screws 23*a* and 23*b* for attaching the vertical positional adjuster 5*b* to the base frame 8. The vertical positional adjuster 5*b* can perform the positional adjustment in the vertical direction over the lengths of the elongate holes 5*b*1 and 5*b*2. The anteroposterior positional adjuster 5*c* is provided with elongate holes 5*c*1 and 5*c*2 extending in the horizontal direction. The elongate holes 5*c*1, 5*c*2 are for introducing therethrough screws 24*a* and 24*b* for attaching the anteroposterior positional adjuster 5*c* to the vertical positional adjuster 5*b*. The anteroposterior positional adjuster 5*c* can perform the positional adjustment in the horizontal direction over the lengths of the elongate holes 5*c*1 and 5*c*2. The anteroposterior positional adjuster 5*c* is separated into upper and lower parts so as to be readily formable.

The base frames 7 and 8 are made of metal. Furthermore, the positional adjusters 5*a* to 5*c* are made of resin or metal. The positional adjusters 5*a* to 5*c* in this embodiment are preferably made of metal if the hinge is upsized. After the positional adjustment, the base frames 7 and 8 are covered with screw covers 26*a*-26*d*.

Figure 5:
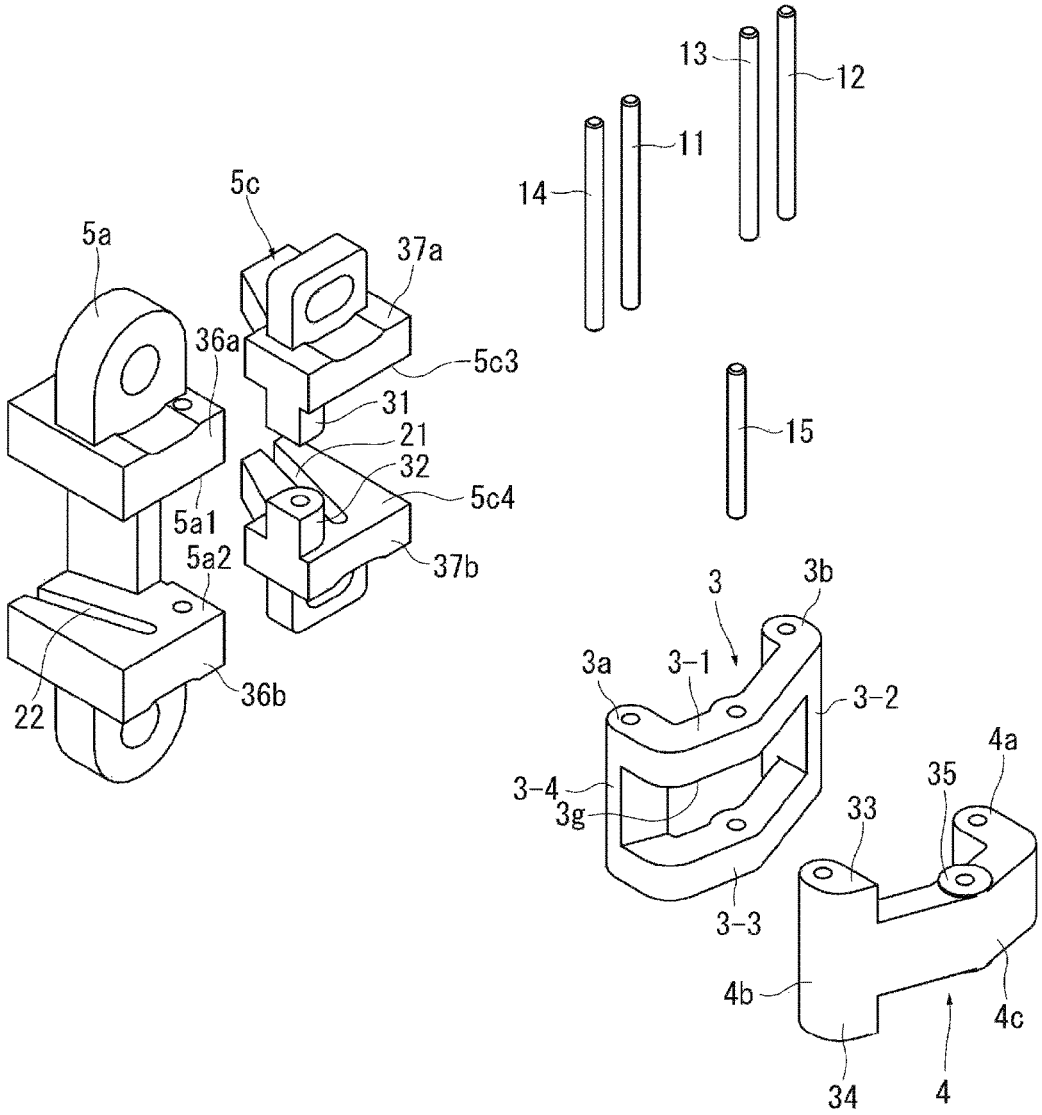
FIG. 5 is an enlarged perspective view of the hinge of the first embodiment.

FIG. 5 is an enlarged view showing the first and second arms 3 and 4, the horizontal positional adjuster 5*a*, and the anteroposterior positional adjuster 5*c* of FIG. 4. As shown in this figure, the first arm 3 is formed into a curved square frame shape having an opening 3*g*. The first arm 3 is formed into a single, closed piece enclosing the opening 3*g*. More specifically, the first arm 3 consists of a top part 3-1, a side part 3-2, a bottom part 3-3 and another side part 3-4, which surround together the opening 3*g* and are continuously formed. The first arm 3 may be configured of two parts as long as the arm has its portion formed into a single, closed structure.

As described above, the first arm 3 has its base end section 3*a* pivotally supported by the horizontal positional adjuster 5*a* via the pivot 11, and also has its fore end section 3*b* pivotally and slidably supported by the anteroposterior positional adjuster 5*c* via the pivot 12. The base end section 3*a* of the first arm 3 is caught by a pair of guide surfaces 5*a*1 and 5*a*2 of the horizontal positional adjuster 5*a*, and the base end section 3*a* comes into contact with the horizontal positional adjuster 5*a* at its two, upper and lower, points. The fore end section 3*b* of the first arm 3 is caught by a pair of guide surfaces 5*c*3 and 5*c*4 of the anteroposterior positional adjuster 5*c*, and the fore end section 3*b* of the first arm 3 comes into contact with the anteroposterior positional adjuster 5*c* at its two, upper and lower, points. Thus, the first arm 3 can bear the load stably at the entire, four points. The pivots 11 and 12 may be inserted in the base end section 3*a* and the fore end section 3*b* of the first arm 3 to thereby bear the load also with the pivots 11 and 12. Nevertheless, the contact points between the first arm 3 and the guide surfaces 5*a*1, 5*a*2 and 5*c*3, 5*c*4 mainly bear the load.

The second arm 4 is formed into a curved T-shape. The second arm 4 has a main body section 4*c* inserted into the opening 3*g* of the first arm 3. The main body section 4*c* extends in the horizontal direction. The main body section 4*c* has its height not exceeding the height in the vertical direction of the opening 3*g*. The second arm 4 thus inserted into the opening 3*g* of the first arm 3 is pivotally coupled to the first arm 3 through a pivot 15.

As described above, the second arm 4 has its base end section 4*a* pivotally supported by the anteroposterior positional adjuster 5*c* via the pivot 13, and has its fore end section 4*b* pivotally and slidably supported by the horizontal positional adjuster 5*a* via the pivot 14. The height of the main body section 4*c* of the second arm 4 is lower than that of the first arm 3. Consequently, a gap δ1 is produced between the upper surface of the main body section 4*c* of the second arm 4 and the guide surface 5*c*3 of the anteroposterior positional adjuster 5*c* (see FIG. 2), and a gap δ2 is produced between the lower surface of the main body section 4*c* of the second arm 4 and the guide surface 5*c*4 of the anteroposterior positional adjuster 5*c* (see FIG. 2). Correspondingly, a gap δ3 is produced between the upper surface of the main body section 4*c* of the second arm 4 and the guide surface 5*a*1 of the horizontal positional adjuster 5*a* (see FIG. 2), and a gap δ4 is produced between the lower surface of the main body section 4*c* of the second arm 4 and the guide surface 5*a*2 of the horizontal positional adjuster 5*a* (see FIG. 2).

Figure 7:
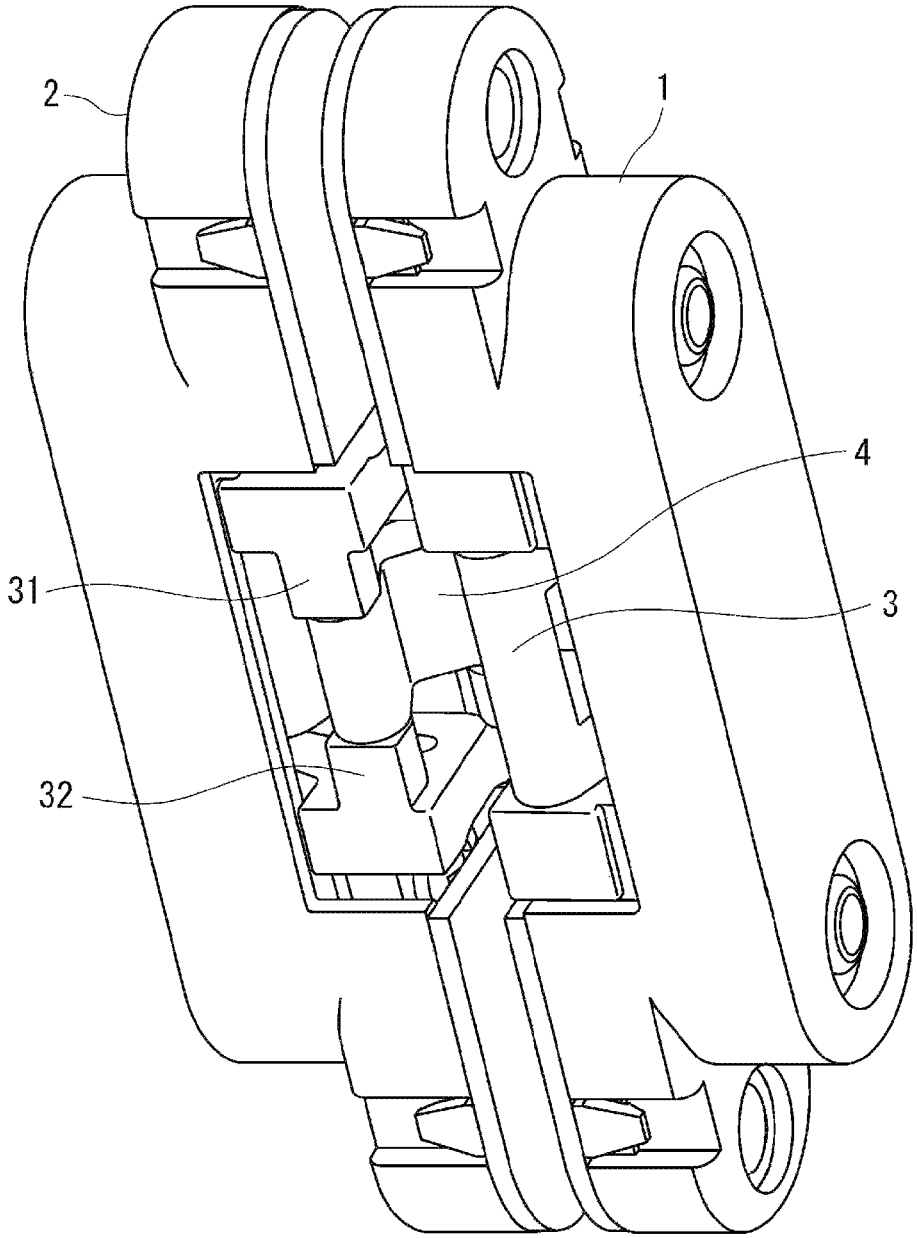
FIG. 7 is a back side perspective view of the hinge of the first embodiment.

The presence of the gaps δ1 to δ4 impairs the stable load-bearing by the second arm 4. As shown in FIG. 5, a first protrusion 31 is provided to fill the gap δ1 and a second protrusion 32 is provided to fill the gap δ2 (regarding the first and second protrusions 31 and 32, see FIG. 6C, showing a cross-sectional view taken along a line C-C of FIG. 2, and FIG. 7 showing a perspective view of the back side of the hinge). In addition, a third protrusion 33 is provided to fill the gap δ3 and a fourth protrusion 34 is provided to fill the gap δ4 (regarding the third and fourth protrusions 33 and 34, see FIG. 2 as well as FIG. 6A, showing a cross-sectional view taken along the line A-A of FIG. 2).

The first to fourth protrusions 31 to 34 can be disposed on the second arm 4 or on the horizontal positional adjuster 5*a* and the anteroposterior positional adjuster 5*c*. In this embodiment, the first and second protrusions 31 and 32 are disposed on the anteroposterior positional adjuster 5*c*, and the third and fourth protrusions 33 and 34 are disposed on the second arm 4. It facilitates the insertion of the second arm 4 into the opening 3*g* of the first arm 3, and can prevent the interference of the third and fourth protrusions 33 and 34 with the first arm 3.

It is to be noted that pivots 13 and 14 are inserted into the base end section 4*a* and the fore end section 4*b* of the second arm 4, thereby enabling to receive the load. Nevertheless, the load is received mainly by the contact points of the base end section 4*a* of the second arm 4 and the second protrusions 31, 32 as well as the contact points of the third and fourth protrusions 33, 34 on the fore end section 4*b* of the second arm 4 and the guide surfaces 5*a*1, 5*a*2 of the horizontal positional adjuster 5*a*. To be exact, most of the entire part of the main body section 4*c* of the second arm 4 is inserted into the opening 3*g* of the first arm 3 while the base part of the main body section 4*c* of the second arm 4 is not inserted into the opening 3*g*. On this base part of the main body section 4*c* of the second arm 4, the third and fourth protrusions 33, 34 are disposed.

As shown in FIG. 5, both of the first and second arms 3 and 4 are formed of metal. For keeping those metals from touching each other, a spacer 35 made of resin is disposed between the first and second arms 3 and 4.

Now, a description will be made on the configurations of the horizontal and anteroposterior positional adjusters 5*a* and 5*c*. As shown in FIG. 5, the horizontal positional adjuster 5*a* includes a pair of generally rectangular upper and lower supporting sections 36*a* and 36*b*. The pair of supporting sections 36*a* and 36*b* has a pair of guide surfaces 5*a*1 and 5*a*2 opposed in parallel to each other. The pair of guide surfaces 5*a*1 and 5*a*2 holds therebetween the base end section 3*a* of the first arm 3 and the fore end section 4*b* of the second arm 4. The pivot 11 acting as the center of rotation of the base end section 3*a* of the first arm 3 penetrates the pair of supporting section 36*a* and 36*b*, and the first arm 3. The base end section 3*a* of the first arm 3 pivots on the pivot 11 while contacting with the pair of guide surfaces 5*a*1 and 5*a*2. Similarly, the pivot 14 as the center of rotation of the second arm 4 penetrates the fore end section 4*b* of the second arm 4. The pair of guide surfaces 5*a*1 and 5*a*2 is provided with grooves 22, into which the opposite ends of the pivot 14 are engaged. On the fore end section 4*b* of the second arm 4, the third and fourth protrusions 33 and 34 are integrally formed. Thus, the number of parts can be reduced, and thereby the assemblability can be improved. The fore end section 4*b* of the second arm 4 pivots on the pivot 14 with the guidance of the pair of guide surfaces 5*a*1 and 5*a*2 while sliding along the grooves 22.

The anteroposterior positional adjuster 5*c* also includes a pair of generally rectangular upper and lower supporting sections 37*a* and 37*b*. The pair of supporting sections 37*a* and 37*b* has a pair of guide surfaces 5*c*3 and 5*c*4 opposed in parallel to each other. The pair of guide surfaces 5*c*3 and 5*c*4 holds therebetween the fore end section 3*b* of the first arm 3. Protruding through the pair of guide surfaces 5*c*3 and 5*c*4 are the first and second protrusions 31 and 32. The base end section 4*a* of the second arm 4 is caught by the first and second protrusions 31 and 32. The pivot 13 as the center of rotation of the base end section 4*a* of the second arm 4 penetrates the base end section 4*a* of the second arm 4. The pivot 13 has its opposite ends respectively inserted into holes formed in the first and second protrusions 31 and 32. The base end section 4*a* of the second arm 4 pivots on the pivot 13 while contacting with the first and second protrusions 31 and 32. The first and second protrusions 31 and 32 are formed integrally with the anteroposterior positional adjuster 5*c*. Thus, the number of parts can be reduced, and thereby the assemblability can be improved. Similarly, the pivot 12 as the center of rotation of the fore end section 3*b* of the first arm 3 penetrates the fore end section 3*b* of the first arm 3. The pair of guide surfaces 5*c*3 and 5*c*4 is provided with grooves 21, into which the opposite ends of the pivot 12 are engaged. The fore end section 3*b* of the first arm 3 pivots on the pivot 12 with the guidance of the pair of guide surfaces 5*c*3 and 5*c*4 while sliding along the grooves 21.

It is to be noted that in this embodiment, the anteroposterior positional adjuster 5*c* is separated into upper and lower elements, in which the first protrusion 31 is formed integral with the upper divided element and the second protrusion 32 is formed integral with the lower divided element. In any case, the first and second protrusions 31 and 32 are formed integral with the anteroposterior positional adjuster 5*c*.

Figure 8A:
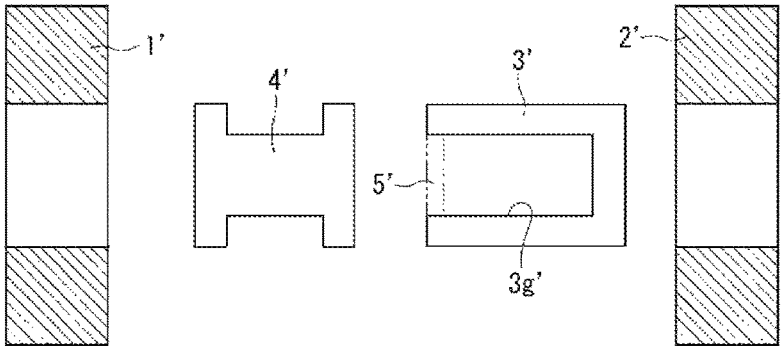
FIGS. 8A and 8B are schematic diagrams comparing shapes of the first and second arms of a conventional hinge with shapes of the first and second arms of the first embodiment.
Figure 8B:
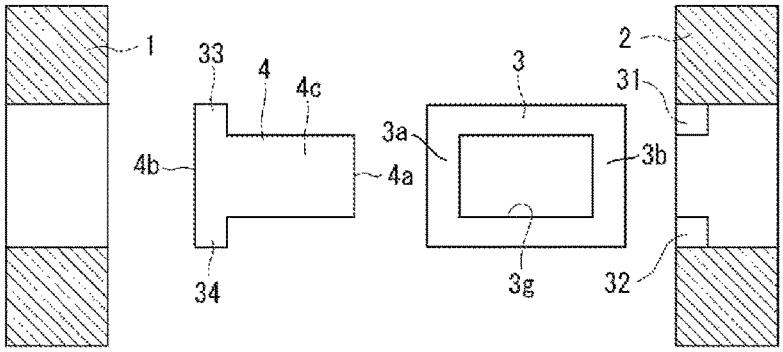

FIG. 8A and FIG. 8B are schematic diagrams comparing the shapes of the first and second arms 3' and 4' of a conventional hinge with the shapes of the first and second arms 3 and 4 of this embodiment. As shown in FIG. 8A, the first arm 3' of the conventional hinge is formed into a C-shape so that the second arm 4' can be inserted into an opening 3*g*' of the first arm 3'. Consequently, the strength of the first arm 3' cannot be enhanced. Even though a spacer 5' is fitted in the first arm 3' after inserting the second arm 4', the first arm 3' will not be strengthen due to the rattle of the spacer 5'.

By contrast, as shown in FIG. 8B, the first arm 3 of the hinge of this embodiment is formed into a closed shape enclosing the opening 3*g*, thereby enabling to enhance the strength of the first arm 3. In order to insert the second arm 4 into the opening 3*g* of the first arm 3, the height in the vertical direction of the main body section 4*c* of the second arm 4 should be made lower. However, since the second hinge main body 2 is provided with the first and second protrusions 31 and 32, the gap between the base end section 4*a* of the second arm 4 and the second hinge main body 2 can be filled. Moreover, the fore end section 4*b* of the second arm 4 is provided with the third and fourth protrusions 33 and 34, which can fill the gap between the fore end section 4*b* of the second arm 4 and the first hinge main body 1.

Figure 9:
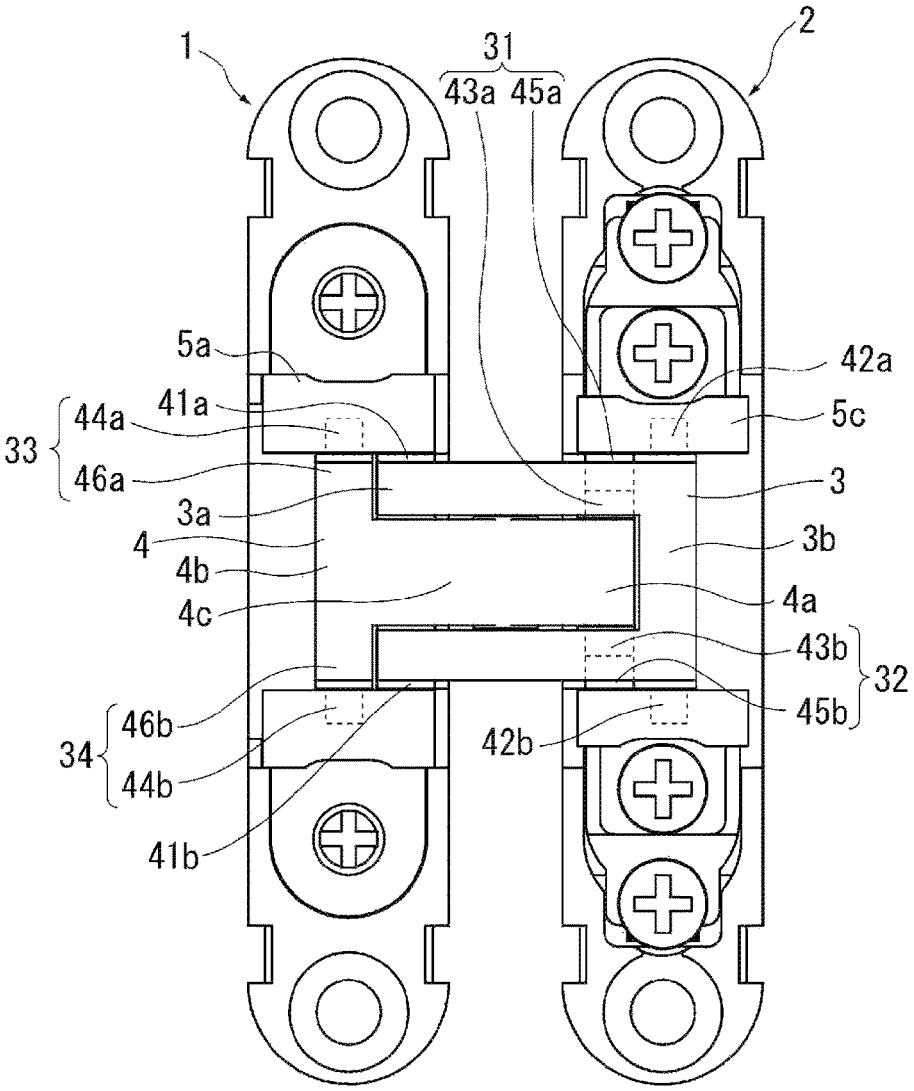
FIG. 9 is a front view of alternative hinge of the first embodiment.

FIG. 9 shows another example of the hinge of this embodiment. The hinge of this example is for a heavy door, in which the horizontal positional adjuster 5*a* and the anteroposterior positional adjuster 5*c* are made of metal. In order to avoid those metals from touching each other, the base end section 3*a* of the first arm 3 and the horizontal positional adjuster 5*a* are provided therebetween with bushes, or spacers, 41*a* and 41*b* whereas the fore end section 3*b* of the first arm 3 and the anteroposterior positional adjuster 5*c* are provided therebetween with rotating blocks 42*a* and 42*b*. In addition, the base end section 4*a* of the second arm 4 and the anteroposterior positional adjuster 5*c* are provided therebetween with bushes 43*a*, 43*b*, or spacers, whereas the fore end section 4*b* of the second arm 4 and the horizontal positional adjuster 5*a* are provided therebetween with rotating blocks 44*a* and 44*b*. The respective shapes of the first and second arms 3 and 4, the horizontal positional adjuster 5*a*, and the anteroposterior positional adjuster 5*c* are almost the same as the hinge of the first embodiment.

The rotating blocks 42*a* and 42*b* of the fore end section 3*b* of the first arm 3 are rotatable with respect to the first arm 3, and are slidably fitted in the grooves 21 of the anteroposterior positional adjuster 5*c* (see FIG. 5). The rotating blocks 44*a* and 44*b* of the fore end section 4*b* of the second arm 4 are rotatable with respect to the second arm 4, and are slidably fitted in the grooves 22 of the horizontal positional adjuster 5*a* (see FIG. 5). In the illustrative example, the first and second protrusions 31 and 32 are composed of first and second protruding main bodies 45*a* and 45*b* formed integral with the anteroposterior positional adjuster 5*c*, and the bushes 43*a* and 43*b*. To the anteroposterior positional adjuster 5*c*, some part of the first protrusion 31, namely the first protruding main body 45*a*, and a part of the second protrusion 32, namely the second protruding main body 45*b*, are integrally formed. Furthermore, the third and fourth protrusions 33 and 34 are composed of third and fourth protruding main bodies 46*a* and 46*b* formed integral with the second arm 4, and the rotating blocks 44*a* and 44*b*. To the second arm 4, a part of the third protrusion 33, namely the third protruding main body 46*a*, and a part of the fourth protrusion 34, namely the fourth protruding main body 46*b*, are integrally formed.

Figure 10:
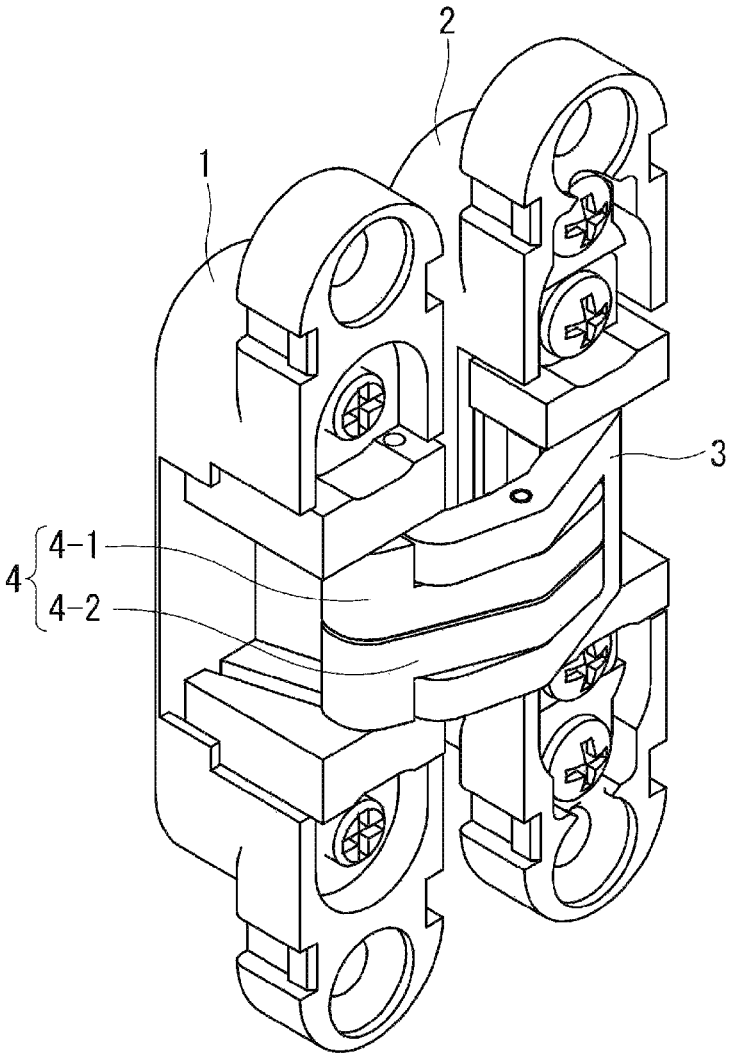
FIG. 10 is a perspective view of a hinge of a second embodiment according to the present invention.

FIG. 10 shows an exemplary perspective view of a hinge according to a second embodiment of the present invention. The hinge of this embodiment is similar to that of the first embodiment, except that the second arm 4 consists of an upper and a lower second arm 4-1 and 4-2 which are separated in the vertical direction. Since the configurations of the first arm 3, the first and second hinge main bodies 1 and 2 are almost the same as the hinge of the first embodiment, the same reference numerals are allotted to avoid repetitive description thereon.

Figure 11:
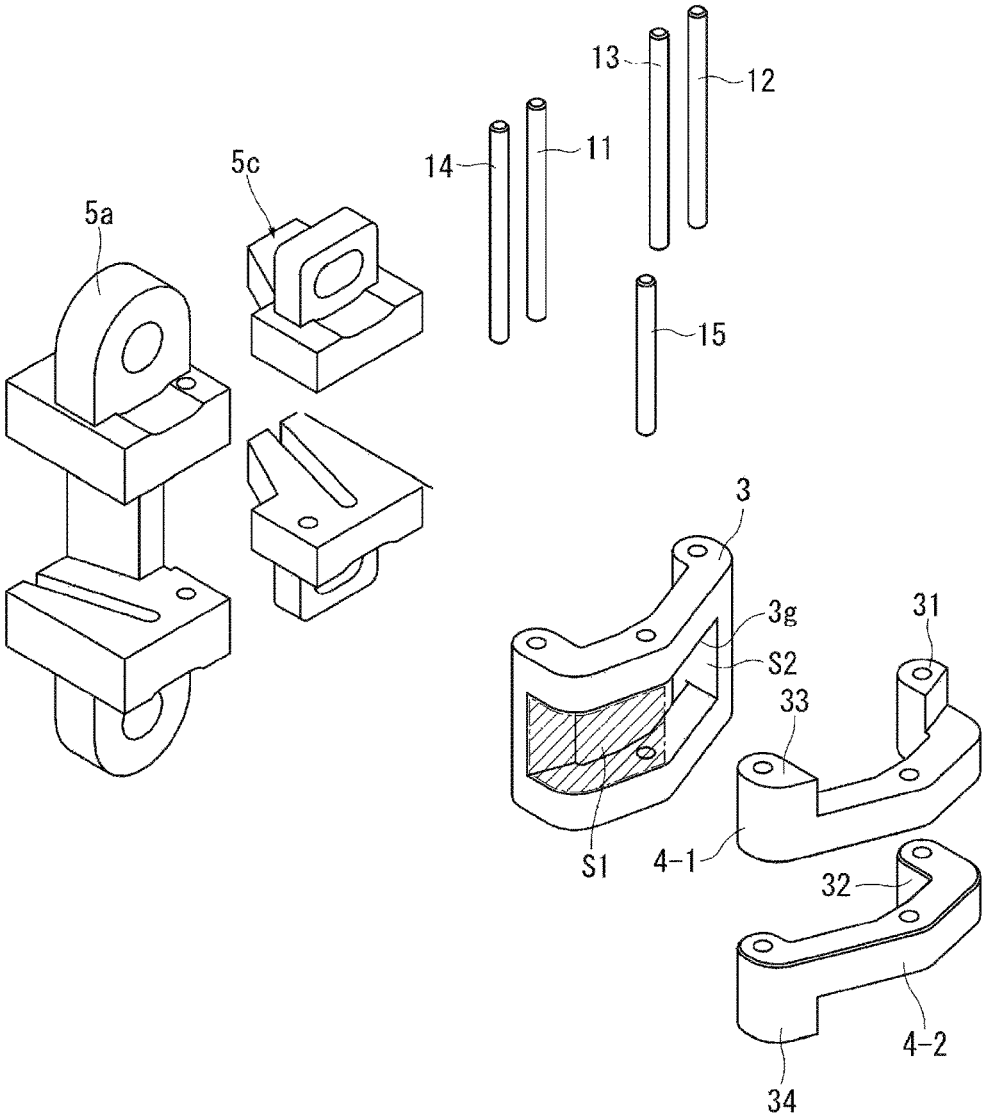
FIG. 11 is a perspective view of a principal part of the hinge of the second embodiment.

FIG. 11 is a perspective view showing a principal part of the hinge of the second embodiment. The first and second protrusions 31 and 32 in the first embodiment are formed integral with the anteroposterior positional adjuster 5*c* whereas the first protrusion 31 of the second embodiment is formed integral with the upper second arm 4-1 and the second protrusion 32 is formed integral with the lower second arm 4-2. Moreover, the third protrusion 33 is formed integral with the upper second arm 4-1 while the fourth protrusion 34 is formed integral with the lower second arm 4-2. The height from the lower surface of the upper second arm 4-1 to the upper surfaces of the first and third protrusions 31 and 33 does not exceed the height of the opening 3*g* of the first arm 3 in the vertical direction. The height from the upper surface of the lower second arm 4-2 to the lower surfaces of the second and fourth protrusions 32 and 34 does not exceed the height of the opening 3*g* of the first arm 3 in the vertical direction.

It is to be noted that between the upper second arm 4-1 and the first hinge main body 1 and between the upper second arm 4-1 and the second hinge main body 2, spacers may be provided. In this case, at least a part of the first protrusion 31 and at least a part of the third protrusion 33 are formed integral with the upper second arm 4-1. Also, between the lower second arm 4-2 and the first hinge main body 1 and between the lower second arm 4-2 and the second hinge main body 2, spacers may be provided. In this case, at least a part of the second protrusion 32 and at least a part of the fourth protrusion 34 are formed integral with the lower second arm 4-2.

After the insertion of the upper second arm 4-1 into the opening 3*g* of the first arm 3, the upper second arm 4-1 is pushed over to an area S1 depicted with oblique lines in FIG. 11 so as to allow the lower second arm 4-2 to be inserted into the other area S2 of the opening 3*g* afterward. In this way, vertically dividing the second arm 4 into two portions permits the second arm 4 to be inserted into the opening 3*g* of the first arm 3.

Figure 12:
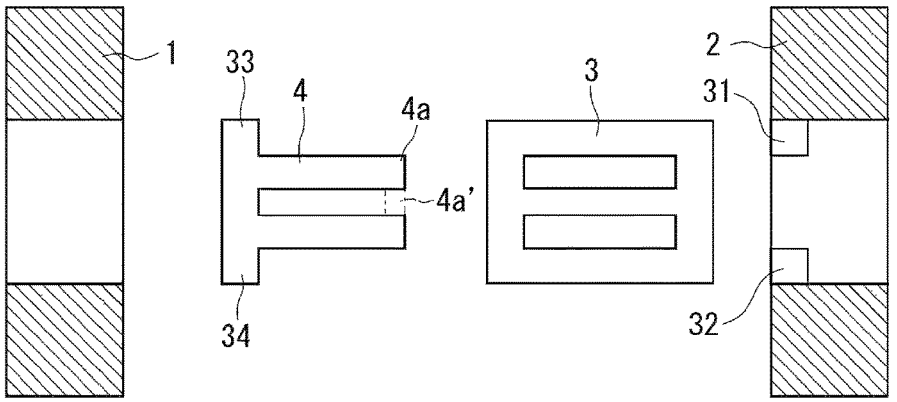
FIG. 12 is a schematic diagram of a hinge of a third embodiment according to the present invention.

FIG. 12 is a schematic diagram showing an exemplary view of a hinge according to a third embodiment of the present invention. In the hinges of the above-described first and second embodiments, the first arm 3 is formed into the square frame shape and the second arm 4 is formed in the T-shape. Alternatively, as shown in FIG. 12, the first arm 3 may be formed in a θ-shape and the second arm 4 may be formed in a π-shape put in a sideways position. In this embodiment, the first and second protrusions 31 and 32 are disposed on the second hinge main body 2. The third and fourth protrusions 33 and 34 are disposed on the second arm 4. Into the base end section 4*a* of the second arm 4 is inserted a spacer 4*a*'. Since the height of the spacer 4*a*' can be made lower than that of the spacer of the conventional hinge, the strength of the second arm 4 does not decrease as much as that of the conventional hinge.

Figure 13:
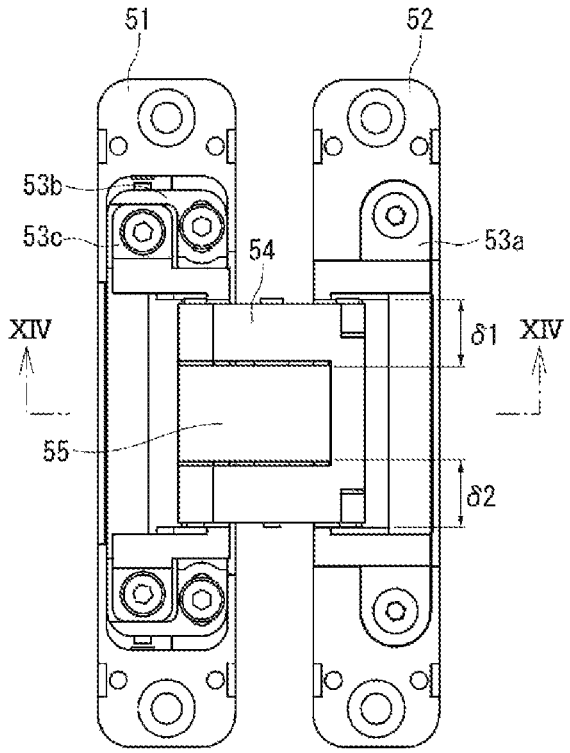
FIG. 13 is a front view of a hinge of a fourth embodiment according to the present invention.
Figure 14:
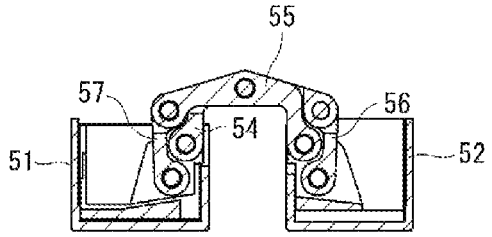
FIG. 14 is a cross-sectional view taken along line XIV-XIV of FIG. 13.
Figure 15:
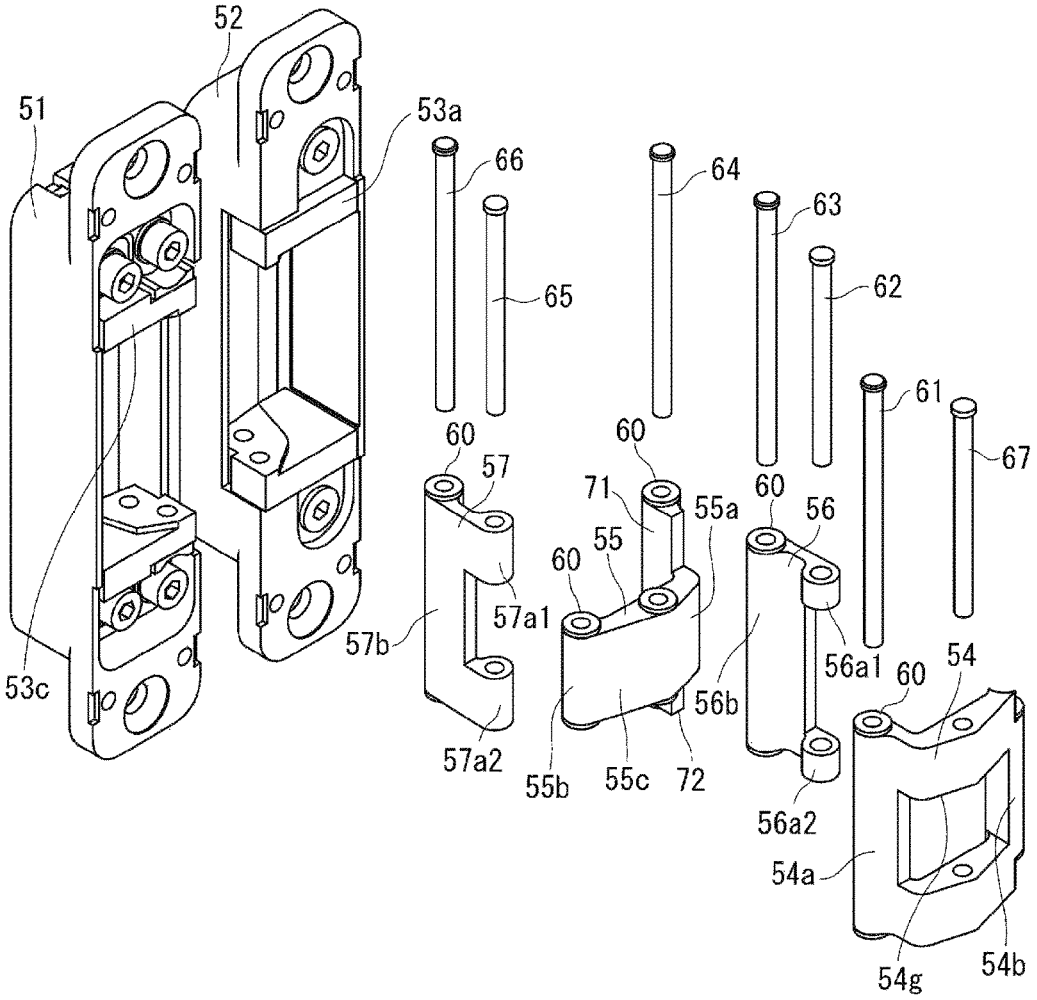
FIG. 15 is an exploded perspective view of the hinge of the fourth embodiment.
Figure 16:
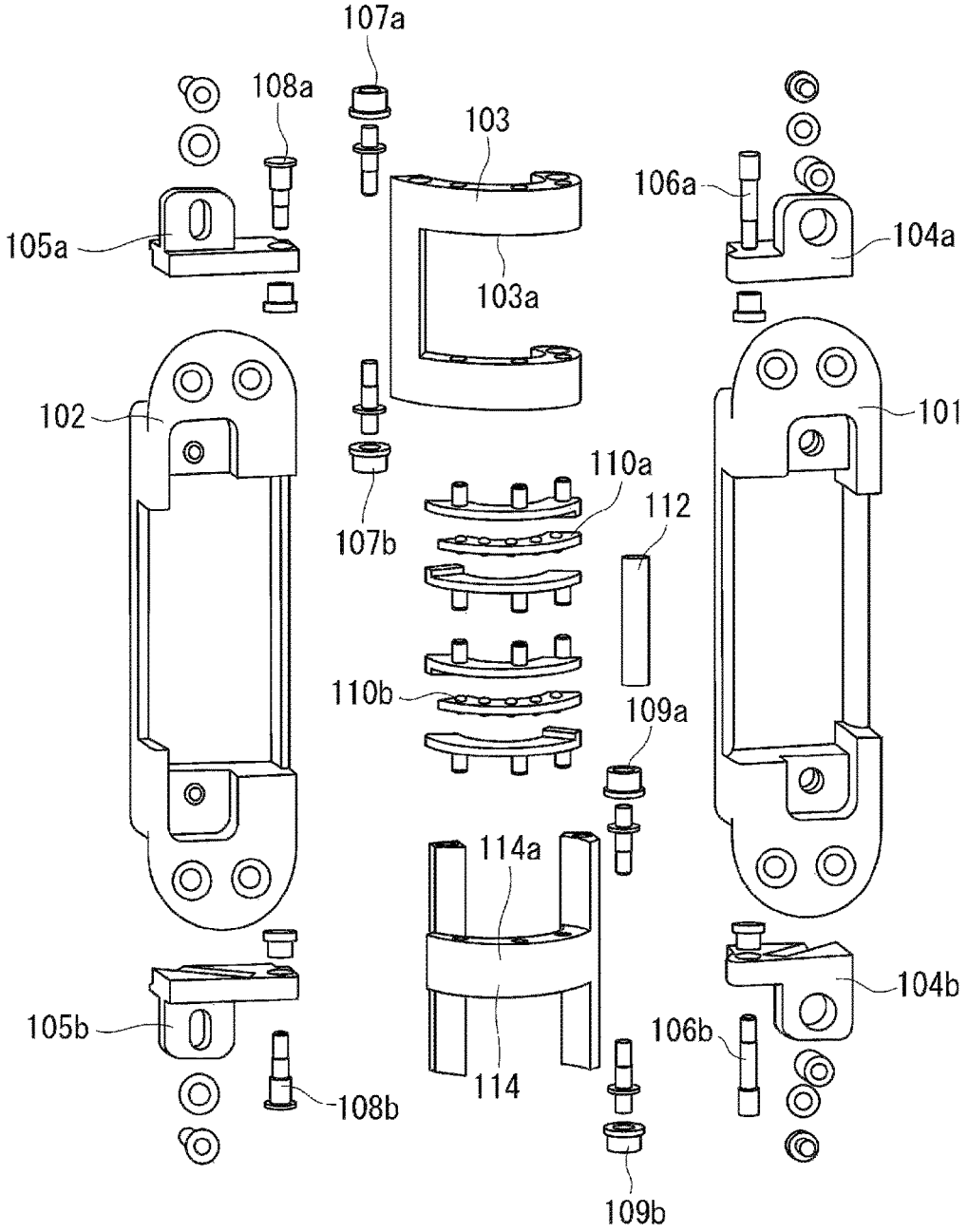
FIG. 16 is an exploded perspective view of the conventional hinge.

FIGS. 13 to 15 illustrate an exemplary view of a hinge according to a fourth embodiment of the present invention. FIG. 13 is a front view, FIG. 14 is a cross-sectional view taken along a XIV-XIV line of FIG. 13, and FIG. 15 is an exploded perspective view of the hinge. The hinge of the fourth embodiment is a link-type hinge (hereinafter referred to simply as "hinge"), and includes a first hinge main body 51 attachable to either one of a door and a frame, and a second hinge main body 52 attachable to the other one of the door d and the frame f. The first and second hinge main bodies 51 and 52 are provided with positional adjusters 53*a* to 53*c* for adjusting a three-dimensional position of the door d. The positional adjusters 53*a* to 53*c* consist of a horizontal positional adjuster 53*a* capable of adjusting a position in the horizontal direction of the door d, a vertical positional adjuster 53*b* capable of adjusting a position in the vertical direction of the door d and an anteroposterior positional adjuster 53*c* capable of adjusting a position in the anteroposterior direction of the door d.

As shown in FIG. 15, the hinge includes seven pivots 61 to 67 in total for coupling first and second hinge main bodies 51 and 52, first and second arms 54 and 55, and first and second links 56 and 57 in a turning-contraposition manner. More specifically, the anteroposterior positional adjuster 53*c* of the first hinge main body 51 pivotally supports a base end section 54*a* of the first arm 54 via the pivot 61. To a fore end section 54*b* of the first arm 54, pivotally coupled are base end sections 56*a*1 and 56*a*2 of the first link 56 via the pivot 62. The first link 56 has its fore end section 56*b* pivotally supported by the horizontal positional adjuster 53*a* of the second hinge main body 52 via the pivot 63.

Furthermore, the horizontal positional adjuster 53*a* of the second hinge main body 52 pivotally supports a base end section 55*a* of the second arm 55 via the pivot 64. To a fore end section 55*b* of the second arm 55, pivotally coupled are base end section 57*a*1 and 57*a*2 of the second link 57 via the pivot 65. The second link 57 has its fore end section 57*b* pivotally supported by the anteroposterior positional adjuster 53*c* of the first hinge main body 51 via the pivot 66. In this embodiment, the first and second hinge main bodies 51 and 52, the first and second arms 54 and 55, and the first and second links 56 and 57 are made of metal. For keeping the metals from touching each other, the above-mentioned elements are provided with resin spacers 60 in between.

The first arm 54 is formed into a curved square frame shape. The first arm 54 has an opening 54*g*. The first arm 54 is formed into a single, closed piece enclosing the opening 54*g*.

The first link 56 bifurcates into the first and second base end sections 56*a*1 and 56*a*2 for holding therebetween the fore end section 54*b* of the first arm 54. The fore end section 54*b* of the first arm 54 is pivotally coupled to the first and second base end sections 56*a*1 and 56*a*2 via the pivot 62.

The second arm 55 is formed into the curved T-shape. The second arm 55 has a main body section 55*c* to be inserted in the opening 54*g* of the first arm 54. The main body section 55*c* extends in the horizontal direction. The main body section 55*c* has its height not exceeding that of the opening 54*g* in the vertical direction. The second arm 55 inserted in the opening 54*g* is pivotally coupled to the first arm 54 through the pivot 67.

The second link 57 bifurcates into the first and second base end sections 57*a*1 and 57*a*2 for holding therebetween the main body section 55*c* of the second arm 55 in the vertical direction. The fore end section 55*b* of the second arm 55 is pivotally coupled to the first and second base end sections 57*a*1 and 57*a*2 of the second link 57 via the pivot 65.

The height of the main body section 55*c* of the second arm 55 is lower than the height of the first arm 54. As a consequence, between the upper surface of the main body section 55*c* of the second arm 55 and the horizontal positional adjuster 53*a* of the second hinge main body 52, a gap δ1 is produced (see FIG. 13), and between the lower surface of the main body section 55*c* of the second arm 55 and the horizontal positional adjuster 53*a* of the second hinge main body 52 is produced a gap δ2 (see FIG. 13). The presence of the gaps δ1 and δ2 impairs the stable load bearing of the second arm 55. As shown in FIG. 15, a first protrusion 71 is provided to fill the gap δ1, and a second protrusion 72 is provided to fill the gap δ2. The first and second protrusions 71 and 72 are formed integral with the second arm 55.

It would be appreciated that the shapes and configurations of the hinges according to the first to fourth embodiments are illustrative only, and thus the hinges can adopt other shapes and configurations without changing the scope of the present invention.

The first and second arms are pivotally coupled to each other via the pivot in the first to fourth embodiments, but also can be pivotally coupled via an arc-shaped bearing.

While the principles of the disclosure have been described above in connection with specific apparatuses, it is to be clearly understood that this description is made only by way of example and not as limitation on the scope of the invention.

The invention claimed is:

1. A hinge comprising:

a first hinge main body attachable to either one of a door and a frame;

a second hinge main body attachable to another one of the door and the frame;

a first arm having a base end section pivotally supported by the first hinge main body and a fore end section pivotally and slidably supported by the second hinge main body; and a second arm having a base end section pivotally supported by the second hinge main body and a fore end section pivotally and slidably supported by the first hinge main body, wherein the first arm has an opening and is formed in a single, closed piece enclosing the opening, the second arm being inserted into the opening of the first arm, and having a main body section whose height does not exceed a height of the opening in a vertical direction, and wherein a first protrusion is provided for filling a gap between an upper surface of the main body section of the second arm and the second hinge main body, a second protrusion is provided for filling a gap between a lower surface of the main body section of the second arm and the second hinge main body, a third protrusion is provided for filling a gap between the upper surface of the main body section of the second arm and the first hinge main body, and a fourth protrusion is provided for filling a gap between the lower surface of the main body section of the second arm and the first hinge main body, wherein the second hinge main body comprises a base frame, a vertical positional adjuster which is provided with elongate holes and extending in the vertical direction, capable of positional adjustment in the vertical direction with respect to the base frame, and a horizontal positional adjuster which is provided with elongate holes and extending in the horizontal direction, capable of positional adjustment of the door in the horizontal direction when the door is at its closed position with respect to the vertical positional adjuster, wherein the hinge comprising screws which attach the vertical positional adjuster to the base frame through the elongate holes of the vertical positional adjuster and screws which attach the horizontal positional adjuster to the vertical positional adjuster through the elongate holes of the horizontal positional adjuster, wherein the horizontal positional adjuster comprises a first supporting section and a second supporting section separated from each other, in which the first supporting section and the second supporting section respectively have surfaces opposed in parallel to each other in the vertical direction, and wherein the base end section of the second arm is abutted by the first protrusion and the second protrusion, the base end section of the second arm is penetrated by a first pivot as the center of rotation of the base end section of the second arm, the first pivot has its opposite ends respectively inserted into holes formed in the first protrusion and the second protrusion, wherein the fore end section of the first arm is penetrated by a second pivot, of which the opposite ends are engaged into the grooves.

2. The hinge in accordance with claim 1, wherein the third and fourth protrusions are disposed on the second arm.

3. The hinge in accordance with claim 2, wherein at least a part of the third protrusion and at least a part of the fourth protrusion are formed integral with the second arm.

* * * * *